US006113094A

United States Patent [19]

Horiguchi et al.

[11] Patent Number: 6,113,094

[45] Date of Patent: Sep. 5, 2000

[54] IMAGE FORMING APPARATUS TO CONTROL OUTPUT OF PAPER SHEETS ONTO A RECEIVING TRAY

[75] Inventors: Shigeru Horiguchi, Kawasaki; Yuji Suzuki; Tetsuya Gotoh, both of Yokohama, all of Japan

[73] Assignee: Ricoh Company, Ltd., Tokyo, Japan

[21] Appl. No.: 09/200,915

[22] Filed: Nov. 30, 1998

[30] Foreign Application Priority Data

Dec. 1, 1997 [JP] Japan ..... 9-330102

[51] Int. Cl.[7] ..... B65H 43/00

[52] U.S. Cl. ..... 271/176; 271/207

[58] Field of Search ..... 271/176, 220, 271/207, 303; 414/926

[56] References Cited

U.S. PATENT DOCUMENTS

| | | | |
|---|---|---|---|
| 3,687,446 | 8/1972 | Neumann et al. | 271/176 |
| 4,927,131 | 5/1990 | Hashimoto et al. | 271/215 |
| 5,033,731 | 7/1991 | Looney | 271/176 |
| 5,139,254 | 8/1992 | Yamashita et al. | 271/215 |
| 5,253,860 | 10/1993 | Hirose et al. | 271/176 |
| 5,260,759 | 11/1993 | Kobayashi | 271/220 |
| 5,467,974 | 11/1995 | Ishiwata et al. | 271/207 |
| 5,823,529 | 10/1998 | Mandel et al. | 271/196 |
| 5,961,115 | 8/1999 | Blanck et al. | 271/207 |

FOREIGN PATENT DOCUMENTS

| | | | |
|---|---|---|---|
| 360236937 | 11/1985 | Japan | 271/176 |
| 5-92847 | 4/1993 | Japan . | |
| 8-340414 | 12/1996 | Japan . | |
| 9-315645 | 12/1997 | Japan . | |

*Primary Examiner*—Donald P. Walsh
*Assistant Examiner*—Daniel K Schlak
*Attorney, Agent, or Firm*—Oblon, Spivak, McClelland, Maier & Neustadt, P.C.

[57] ABSTRACT

An image forming apparatus which can control a number of paper sheets to be stacked onto a paper receiving tray based on a read paper sheet size. This structure is particularly relevant if a receiving paper tray is inclined and has an area above the paper receiving tray limited by a structure formed above the paper receiving tray. A height of stacked paper sheets on the paper receiving tray can be sensed, and a number of paper sheets allowed to be stacked on the paper receiving tray can be limited based on the read paper size and the sensed height of the stack of paper sheets. Further, the number of paper sheets allowed to be stacked onto the paper receiving tray can be limited based on the read paper size.

39 Claims, 7 Drawing Sheets

IMAGE FORMING APPARATUS TO CONTROL OUTPUT OF PAPER SHEETS ONTO A RECEIVING TRAY

BACKGROUND OF THE INVENTION

1. Field of the Invention

The present invention is directed to an image forming apparatus, such as a copier, a printer, a facsimile, a multiple-function machine, etc., which includes a receiving tray formed under another structure, and more particularly the present invention is directed to such an image forming apparatus which can control the output of paper sheets onto the receiving tray.

2. Discussion of the Background

It is known in image forming apparatuses to incorporate a receiving tray which leans upwards from a base-end to a front-end to contact a wall. The base-end of the receiving tray is located at a paper discharge outlet and at a wall of a main body of the image forming apparatus. When paper sheets are discharged onto this receiving tray edges of the discharged paper sheets are stacked and aligned with the wall of the main body of the image forming apparatus. In such a device a maximum height of the stacked paper sheets is essentially equal to a height from the base end of the receiving tray to the paper discharge outlet.

Furthermore, as image forming apparatuses become more compact, a structural member may be formed above the receiving tray. For example, an automatic document feeder or a scanner may be formed above the receiving tray. In this type of machine with a structural member formed above the receiving tray, an amount of the stacked paper sheets is limited to have a thickness of the gap height from a top of the receiving tray to the structural member formed above the receiving tray. Further, if such a receiving tray is angled from the paper discharge outlet upward, if long sized paper sheets are discharged onto the receiving tray, the height of the stack of long paper sheets is even further reduced. This results because the edge of such stacked long paper sheets will be at an area where the gap height between a top of the receiving tray and the structural member formed above the receiving tray is further reduced. Moreover, in such a device if long paper sheets are discharged onto the receiving tray the long paper sheets may become jammed between the receiving tray and the structural member formed above the receiving tray because the gap height at the edges of the long paper sheets may be less than a distance from a bottom of the receiving tray to the paper discharge outlet.

SUMMARY OF THE INVENTION

Accordingly, one object of the present invention is to provide a novel image forming apparatus which can overcome the above-noted and other drawbacks in the background art.

A further object of the present invention is to provide a novel image forming apparatus with a novel control method for controlling the stacking of paper sheets onto a discharge paper receiving tray.

The present invention achieves these and other objects by determining paper size data of paper sheets to be stacked onto a paper receiving tray, and limiting the number of paper sheets to be stacked onto the paper receiving tray based on this detected paper size data.

One specific implementation of the novel image forming apparatus of the present invention is to sense the height of stacked paper sheets on the paper receiving tray and limit the number of paper sheets allowed to be stacked onto the paper receiving tray based on the sensed height and based on a size of the paper sheets. A further specific implementation of the novel image forming apparatus of the present invention is to limit the number of paper sheets to be discharged onto the paper receiving tray based on the paper size data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
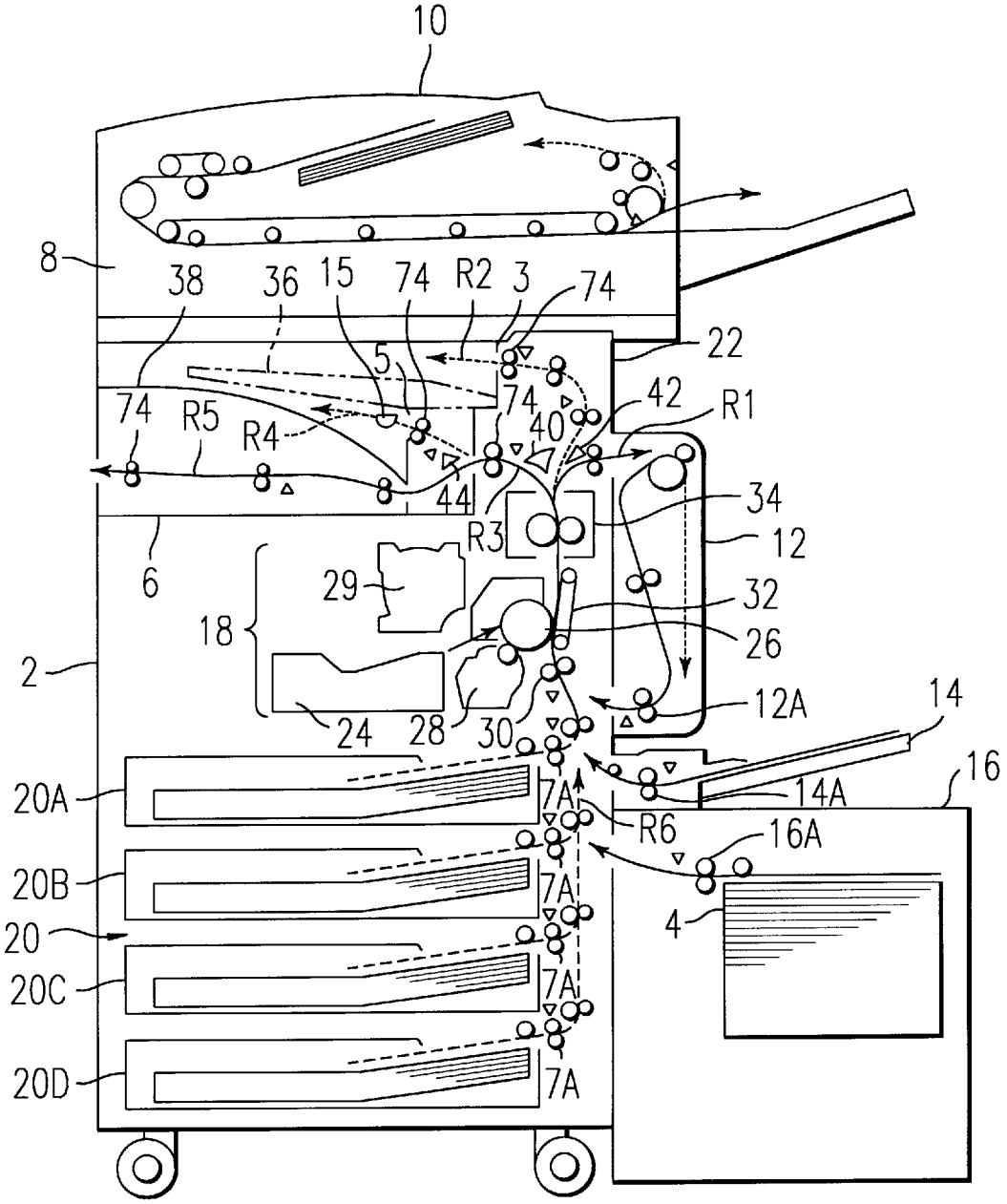
FIG. 1 shows an overall view of an image forming apparatus implementing the present invention.

Referring now to the drawings, wherein like reference numerals designate identical or corresponding parts throughout the several views, an image forming apparatus which can implement the present invention is shown in detail in FIG. 1. FIG. 1 shows an image forming apparatus as a multi-function digital copier. The present invention is applicable to other image forming apparatuses as will be apparent from the following discussion.

The image forming apparatus of FIG. 1 includes a main body 2. A transmit feeding device 6 is provided for feeding sheets of printed paper 4 discharged from the main body 2 to a finishing device (not shown but which would be equipped at a left side of the main body 2 as shown in FIG. 1). Further, an image reading device 8 is equipped over the main body 2.

The image reading device 8 includes an automatic document feeder (ADF) 10.

An auto reverse unit 12 is equipped at a right side of the main body 2, and a high-volume paper supply cassette 16 is detachable from the main body 2 and feeds paper sheets 4 by feeding roller pair 16*a*.

The image forming apparatus also includes a first outlet 3 for discharging paper sheets having images formed thereon onto a first receiving tray 36 and a second outlet 5 for discharging paper sheets having images formed thereon onto a second receiving tray 38. The several solid delta symbols shown in FIG. 1 indicate various paper sheet detectors.

As is clear from FIG. 1, the area formed above the receiving trays 36 and 38 is limited by the image reading device 8. Of course, other elements could be formed above the paper receiving trays 36 and 38 to limit the heights thereof.

The image forming apparatus shown in FIG. 1 utilizes a so-called "vertical feeding path system". In this system the main body 2 includes an image forming part 18 in a central portion and a branch part 22 for selecting the outputting of paper sheets from the first outlet 3 or the second outlet 5. This branch part 22 is formed at an upper part of the image forming part 18. Further, paper sheets can be stocked in a paper supply part 20 including paper supply cassettes 20*a*, 20*b*, 20*c*, and 20*d*. Paper sheets from the paper supply part 20 are vertically fed through a feeding path located at a right side of the main body 2, images are formed on the fed paper sheets, and then the paper sheets with images formed thereon are discharged to the paper receiving trays 36 and 38.

The image forming part 18 forms an image on the paper sheets based on image data transmitted from the image reading device 8 or an external information device, such as a personal computer. More specifically, an image writing unit 24 forms a latent image on the photosensitive drum 26 based on the transmitted image data, and latent images are then developed into visible images by developing unit 28.

When an operator indicates printing out of the paper sheets, paper is manually or automatically selected from the paper supplying part 20, a manual supply tray 14, or paper feeder 16. A feed timing of such paper sheets is synchronized with a front end of a visible image on the photosensitive drum 26 by timing rollers 30. The paper sheet then is provided to a transfer device 32 for transferring a visible image onto the paper sheet. Then, the paper sheet is provided to a fixing device 34 to fix a toner image thereon, and then is provided to the branch part 22. Element 29 shows a toner supply for supplying new toner to the developing unit 28.

There are five paths formed about the branch part 22 including (1) a first path R1 in which paper is sent to the auto reverse unit 12, (2) a second path R2 in which paper is sent to the first tray 36 equipped over the transmit feeding device 6, (3) a third path R3 in which paper is sent to the transmit feeding device 6, (4) a fourth path R4 in which paper is sent to the top surface of the transmit feeding device 6, i.e., the second tray 38, and (5) a fifth path R5 in which paper is sent to the finishing device through the transmit feeding device 6.

The first path R1 and the second path R2 are selectively branched by branch selectors 40 and 42. The fourth path R4 and the fifth path R5 are selectively branched by branch selector 44. A sixth path R6 is a path for guiding paper sheets from the paper supply part 20 to the image forming part 18, and a top portion of path R6 also guides paper sheets from manual supply tray 14 and guides paper sheets from the high volume paper supply cassette 16.

Paper fed to the auto reverse unit 12 is turned upside down and is then refed to the image forming part 18 to form an image on the reverse side of the paper sheet. Further, plural sets of feeding rollers 74 are set along paths R1 to R6 as necessary. Supply roller pairs 7*a*, 12*a*, 14*a*, and 16*a* are each provided at openings of the paper supply part 20, the auto reverse unit 12, the manual supply tray 14, and the high-volume paper supply cassette 16. These supply roller pairs 7*a*, 12*a*, 14*a*, and 16*a* and feeding rollers 74 are driven by a driving motor 159, see for example FIG. 2, and a transfer mechanism (not shown).

Figure 2:
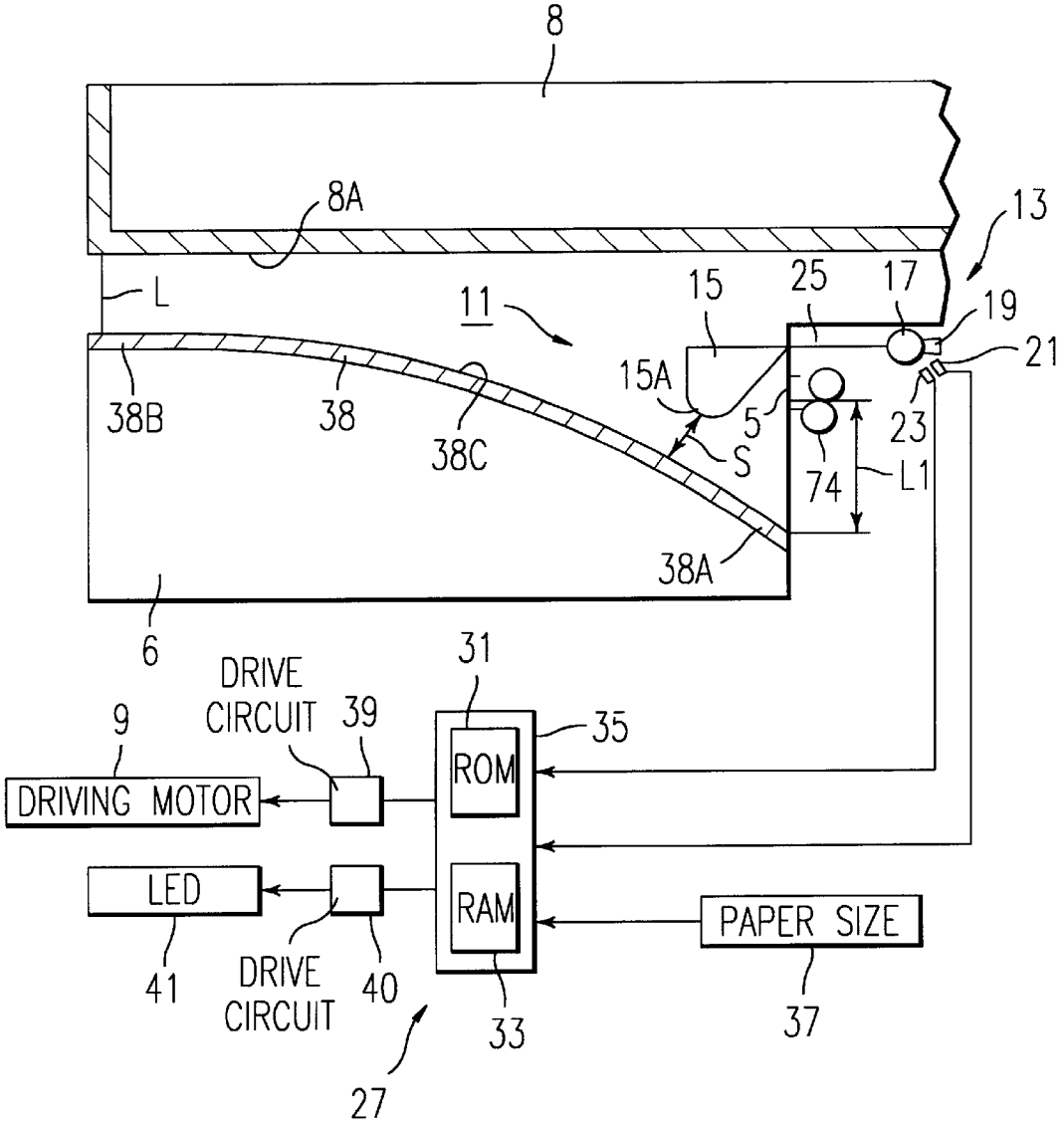
FIG. 2 shows a more detailed view of specific elements of the image forming apparatus of FIG. 1.

Referring now to FIG. 2, FIG. 2 shows in further detail the portion of the image forming apparatus of FIG. 1 about the paper receiving tray 38. Certain control elements are also shown in FIG. 2. FIG. 2 omits the first paper receiving tray 36 for clarity.

As shown in FIG. 2, a space 11 is formed above the paper receiving tray 38 and below the image reading device 8. The paper sheets discharged onto the paper receiving tray 38 fill up this space 11. That is, paper sheets output from the paper discharge outlets 3 and 5 fill this space 11. The first tray 36 may typically be removable from the main body 2 and is leaned such that a front edge of the first tray 36 is higher than its base end. The second tray 38 is typically integral with a top surface of the transmit feeding device 6 and is located under the first tray 36. As is clear from FIG. 2 the first tray 38 is angled such that a gap height between atop of the first tray 38 and the image forming apparatus 8 is variable (i.e., is variable to L).

In further detail, the second tray 38 includes a base-end 38*a* and a front-end 38*b*, and an angled surface with a curve is formed between the base-end 38*a* and the front-end 38*b*, as shown in FIG. 2. The base-end 38*a* is located below the paper discharge outlet 5 and is lower than the front-end 38*b*. As a result, a space L formed between the front-end 38*b* and the bottom 8*a* of the image reading device 8 is the smallest distance within the space 11. A space L1 is formed between the paper discharge outlet 5 and the base end 38*a* and is larger than the space L by a distance $\alpha$, as shown in FIG. 3.

As discussed above, the background art suffers from a problem in that if a long paper sheet is discharged onto such a paper receiving tray 38, the long paper sheets can be jammed as the long paper sheets may extend into the area with the gap height L, which is less than the distance L1 between the bottom of the base-end 38*a* of the paper receiving tray 38 and the paper discharge outlet 5.

Figure 3:
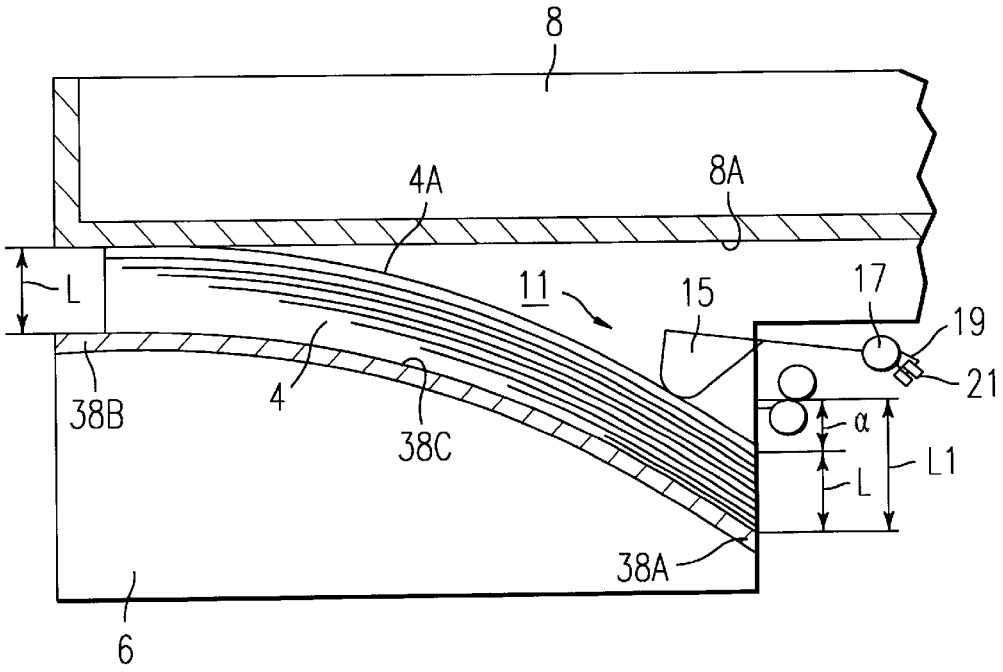
FIG. 3 shows one operation of the image forming apparatus of FIG. 1 in which first sized paper sheets are discharged onto a paper receiving tray.

To overcome such a problem, in a first embodiment as shown in FIG. 3, the present invention includes a detecting device 13 which can detect a height of the paper sheets stacked onto the paper receiving tray 38. The detecting device 13 is located about the position of the paper discharge outlet 5 in the space 11. The detecting device 13 includes a shaft 17, a float part 15 which moves based on a height of stacked paper sheets about the shaft 17, a shield 19 protruding from the shaft 17, a first sensor 21, and a second sensor 23. The float part 15 may be shaped hemispherically and coupled to the shaft 17 by a lever 25. A distance S between a bottom surface 15*a* of the float part 15 and the top surface 38*c* of the paper receiving tray 38 is less than a distance of the smallest gap height L in an initial state.

The shield 19 adopts a position such that shield 19 is not sensed by either sensor 21 or sensor 23 in an initial condition in which no paper sheets are stacked onto the paper receiving tray 38.

Figure 4:
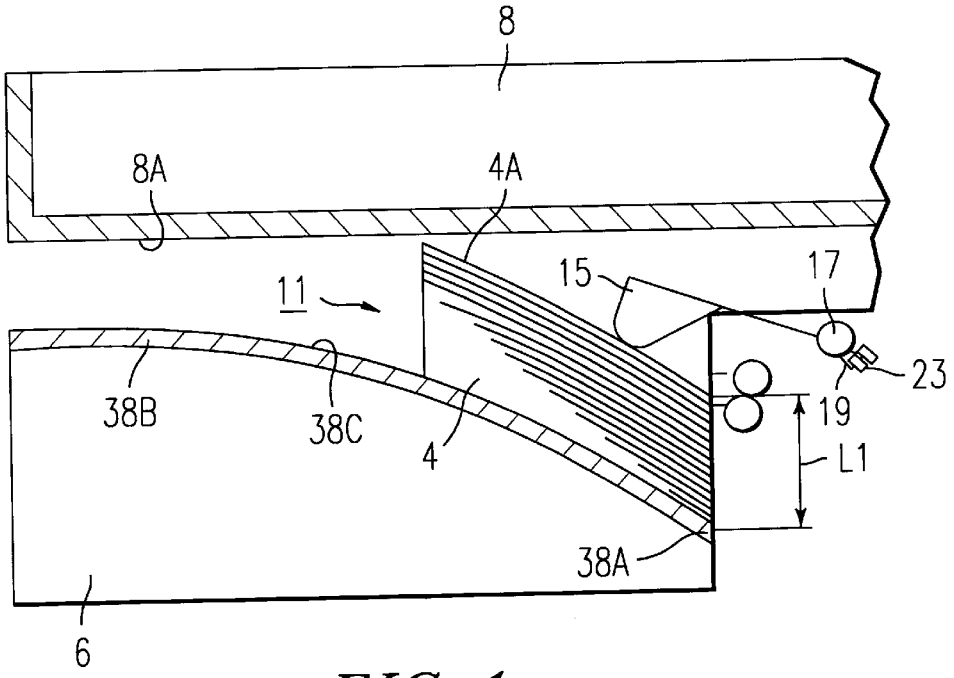
FIG. 4 shows one operation of the image forming apparatus of FIG. 1 in which second sized paper sheets are discharged onto a paper receiving tray.

The operation of the present invention when two different sized paper sheets are stacked onto the paper receiving tray 38 is now explained in further detail with respect to FIGS. 3 and 4. FIG. 3 shows a situation in which long paper sheets are stacked onto the paper receiving tray 38 and FIG. 4 shows a situation in which shorter length paper sheets are stacked onto the paper receiving tray 38. As is shown in FIGS. 3 and 4 a greater number of shorter paper sheets can be stacked onto the paper receiving tray 38 because the shorter paper sheets only extend partway to an area on the paper receiving tray 38. That is, edges of the shorter paper sheets only extend partway on paper receiving tray 38 to an area with a gap height greater than L at the front-end 38*b* of the paper receiving tray 38.

As shown in FIG. 3, when long paper sheets are stacked onto the paper receiving tray 38 to a heigh of L, indicating the maximum height of the long paper sheets which should properly be stacked onto the paper receiving tray 38, the float 15 is moved upward so that the shield 19 is sensed by the first sensor 21. Further, when shorter length paper sheets are stacked onto the paper receiving tray 38 to a height L1 as shown FIG. 4, indicating the maximum height of the shorter length paper sheets which should properly be stacked onto the paper receiving tray 38, the float 15 moves up even further so that the shield 19 is sensed by the second sensor 23.

With this operation, when the first sensor 21 outputs a signal indicating sensing the shield 19, that indicates that the paper sheets are stacked onto the paper receiving tray 38 to a height L. When the second sensor 23 outputs a signal indicating sensing the shield 19, that indicates that paper sheets are stacked onto the paper receiving tray 38 to a height L1. Thus, the first sensor 21 and the second sensor 23 detect a level of the float part 15 by detecting a level of the shield 19. These sensors 21 and 23 can be formed as conventional photosensors which generate detecting signals. These detecting signals are then provided to a controller 27, see FIG. 2. In this embodiment, the controller 27 is utilized to control the amount of the paper sheets discharged onto the paper receiving tray 38 based on a size of the paper sheets to be discharged onto the receiving tray 38 and the outputs of sensors 21 and 23. This controller 27 can also control other elements within the image forming apparatus if desired.

Returning to FIG. 2, which shows the details of the controller 27, the controller 27 includes a control portion 35, which in turn includes a well-known ROM 31 and RAM 33. The ROM 31 stores programs to execute control operations, such as in the flowcharts shown in FIGS. 5 and 6 and discussed below, and size data of paper sheets. A detection signal output from the first sensor 21 is utilized in a mode in which paper sheets are only to be stacked to a height L, and a detection signal output from the second sensor 23 is utilized in a mode in which paper sheets are to be stacked to a height L1, as described in further detail below. This control portion 35 is electrically connected with the first and second sensors 21 and 23, a paper size sensor 37 which can sense or determine a size of paper sheets to be discharged onto the paper receiving tray 38, a drive motor 9 via a drive circuit 39, and an LED 41 via a drive circuit 40. The LED 41 is provided on the front side of the image forming apparatus and can provide an alarm indication to an operator.

In one implementation, the paper size sensor 37 may be made of a plurality of paper size sensors placed in the paper supply cassettes 20*a* to 20*d*, the manual supply tray 14, and the high-volume paper supply 16. Paper size data of paper sheets to be discharged can be detected from a corresponding paper size sensor 37 and then sent to the controller 27. Other types of paper size sensors can also be utilized for the paper size sensor 37. As a further example, paper size data can be sent from a paper select key on an operation panel, in which case the controller 27 recognizes the selected paper size as read paper size data.

The control operation executed by the present invention in the first embodiment is now described with respect to the control operation shown in FIG. 5, again corresponding to data stored in the ROM 33 and RAM 34 of the control part 35.

Initially, the paper size is read in a step S1 by the paper size sensor 37 in any of the various manners discussed above. The operation then proceeds to step S2 in which it is determined whether the read paper size is greater than a threshold size, e.g., a normal sized sheet. If YES in step S2, indicating that a larger than normal size paper sheet is to be discharged onto the paper discharge tray 38, operation is set up in an L-mode in step S3. This L-mode in step S3 establishes that paper sheets are only allowed to be discharged onto the paper discharging tray 38 to a height L, i.e., until the first sensor 21 detects the shield 19. If the L mode is set in step S3, the operation then proceeds to step S4 in which it is determined whether the first sensor 21 is on or not. When the first sensor 21 turns on, i.e. YES in step S4, this indicates that no more larger sized paper sheets should be discharged onto the paper receiving tray 38 as the stack of paper sheets on the paper receiving tray 38 is approximately equal to the gap height L available at the edge of such sheets.

That is, in the paper stacking operation, as the paper sheets pile up on the second paper receiving tray 38 nearly up to the equal to the distance S, a top paper sheet on the second paper receiving tray 38 comes in contact with the bottom surface 15*a* of the float part 15. As more paper sheets are discharged onto the paper receiving tray 38, the float part 15 is lifted up and the shield 19 is rotated in a counterclockwise direction. When the shield 19 then reaches the detecting position of the first sensor 21 as shown in FIG. 3, the first sensor 21 generates a detect signal in step S4, i.e., YES in step S4, and the operation then proceeds to step S5.

At this point the stacking of paper sheets onto the paper receiving tray 38 is stopped in step S5. The operation then proceeds to step S6 where an alert LED is lit so that an operator can be made aware of this situation. Prior to step S6, an optional step S9 can also be executed in which after the paper sheets are stopped from being stacked onto the paper receiving tray 38 in step S5, the paper sheets are stacked to an alternative tray, which could be implemented, for example, by the first tray 36. That is, this stopping of stacking of paper sheets onto the paper receiving tray 38 in step S5 can either merely stop image formation completely, or can then stack the paper sheets to an alternative tray, as noted in step S9.

Returning to step S2, if in step S2 it is determined that the read paper size is not greater than the threshold size, i.e., NO in step 52 indicating that normal sized sheets are to be stacked onto the paper receiving tray 38, the operation then sets an L1 mode in step S7. This L1 mode indicates that paper sheets can be stacked onto the paper discharging tray 38 up to a height L1 since normal sized paper sheets are being used. The operation then proceeds to step S8 in which it is determined whether the second sensor 23 is on or not. When the second sensor 23 detects the shield 19, this provides an indication that a limit of the amount of normal sized paper sheets have been stacked onto the paper receiving tray 38, i.e., the normal sized paper sheets have been stacked up to a height L1. The operation then proceeds to step S5 and then proceeds as discussed above.

With such an operation of the present invention only an appropriate number of paper sheets are stacked onto the paper receiving tray 38 based on the size of the paper sheets, and this thereby prevents any clogging or jamming of the paper sheets at the paper receiving tray 38.

Figure 5:
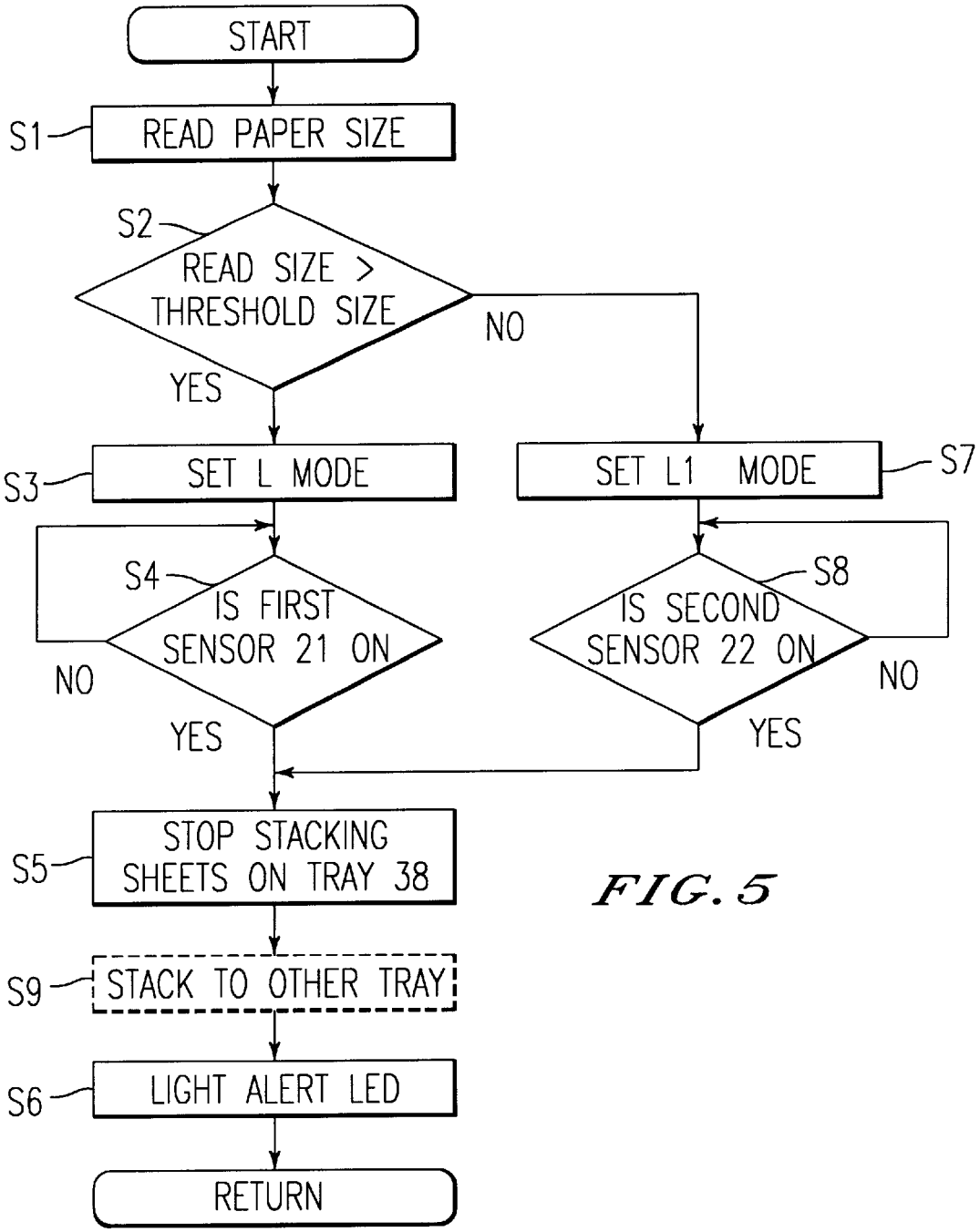
FIG. 5 shows a control operation in one embodiment of the present invention.
Figure 6:
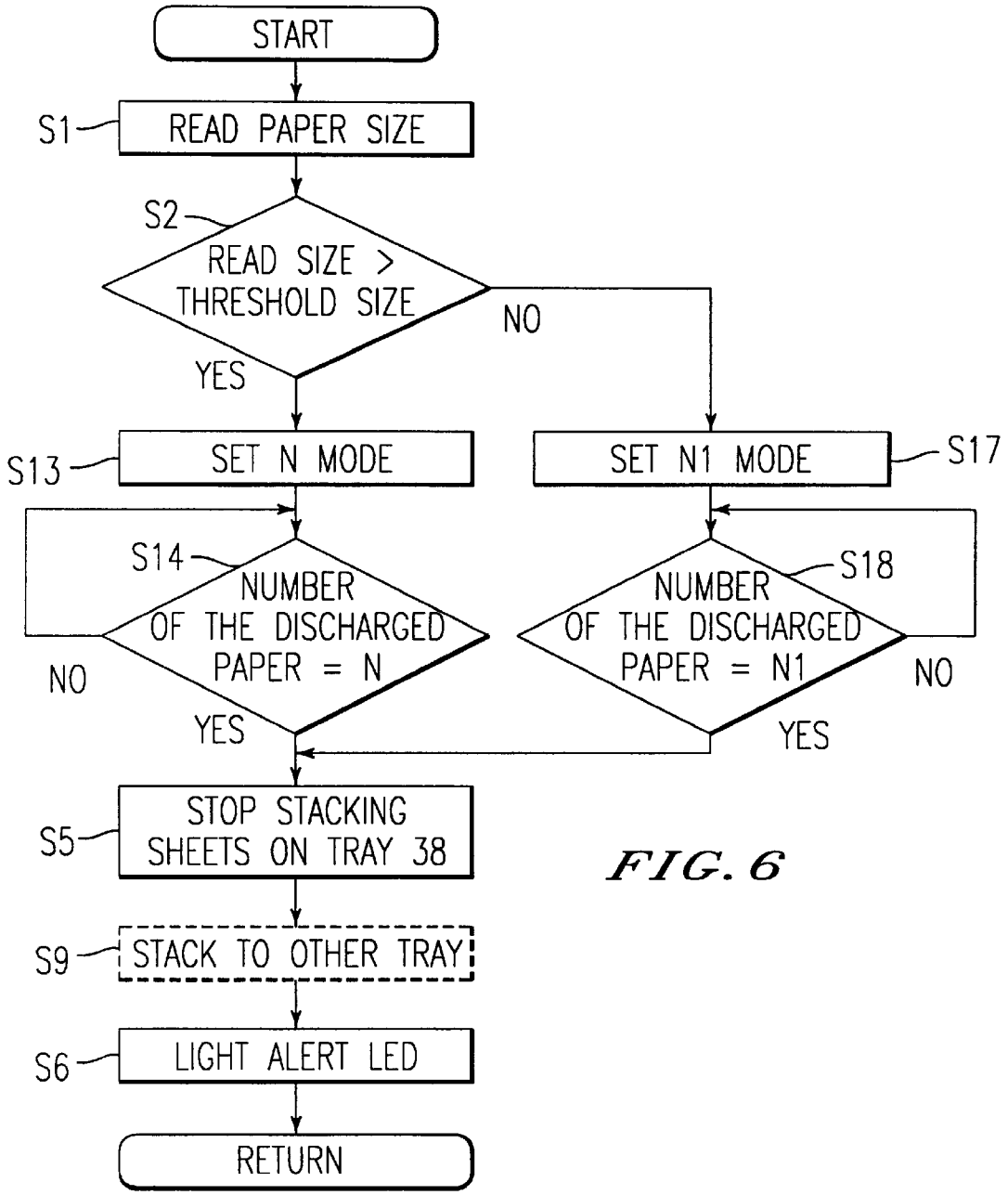
FIG. 6 shows a control operation in a further embodiment of the present invention.

This control operation in the present invention as shown in FIG. 5 is specifically directed to utilizing sensor 13 which senses a height of the paper sheets stacked onto the paper receiving tray 38. However, a further embodiment of the present invention as shown in FIG. 6 can also be implemented, and in this second embodiment the sensor 13 is not needed. The same control steps executed in this operation in FIG. 6 as executed in the operation in FIG. 5 are designated by the same reference numerals, and redundant explanations thereof are omitted.

In this further embodiment as shown in FIG. 6 an actual number of copy operations allowed to be executed to discharge paper sheets onto the paper receiving tray 38 is limited based on the read paper size. More particularly, the operation in FIG. 6 is similar to that in FIG. 5 except step S13 does not set a L-mode, but instead sets an N-mode, where N is a first predetermined number of paper sheets of the longer size allowed to be discharged onto the paper receiving tray 38. Similarly, the operation in step S17 sets an N1 mode indicating a second predetermined number of normal sized paper sheets allowed to be discharged onto the paper receiving tray 38. Then, in step S14 it is determined whether the number of discharged sheets equals the previously set number N, and in step S18 it is determined whether the number of discharged sheets equals the previously set number N1.

In this further control operation of the present invention, instead of actually sensing the height of the paper sheets stacked onto the paper receiving tray 38, it is instead predetermined how many sheets of certain sizes are allowed to be stacked onto the paper discharge tray 38. These predetermined number of sheets (N, N1) are then stored in the control part 35. Then, when the predetermined number of sheets is reached, the stacking of the paper sheets onto the second receiving tray 38 is stopped, similarly as in the embodiment of FIG. 5.

The number of paper sheets N and N1 allowed to be stacked onto the paper receiving tray 38 is based on a preestablished correspondence between a height at edges of stacks of N and N1 paper sheets on the paper receiving tray 38, and is based on the size of such N, N1 paper sheets. Stated another way, in the embodiment of the present invention as shown in FIG. 6, when the read paper size indicates longer paper sheets to be stacked onto the paper receiving tray 38, i.e., the N mode in step S13 and such as is shown in FIG. 3, data already stored in the control part 35 indicates the number N of paper sheets of the longer size which correspond to a stack height L. Similarly, when normal sized paper sheets are to be stacked onto the paper receiving tray 38, i.e., the N1 mode in step S17, a stored number N1 corresponds to a number of paper sheets of normal size which equal a stack height of L1, similarly as shown in FIG. 4.

This further operation in the present invention in the control of FIG. 6 provides the benefit that sensor circuitry 13 is not needed. However, this control operation of FIG. 6 has the drawback in not being as accurate in not actually sensing the height of the paper sheets stacked onto the paper receiving tray 38.

Figure 7:
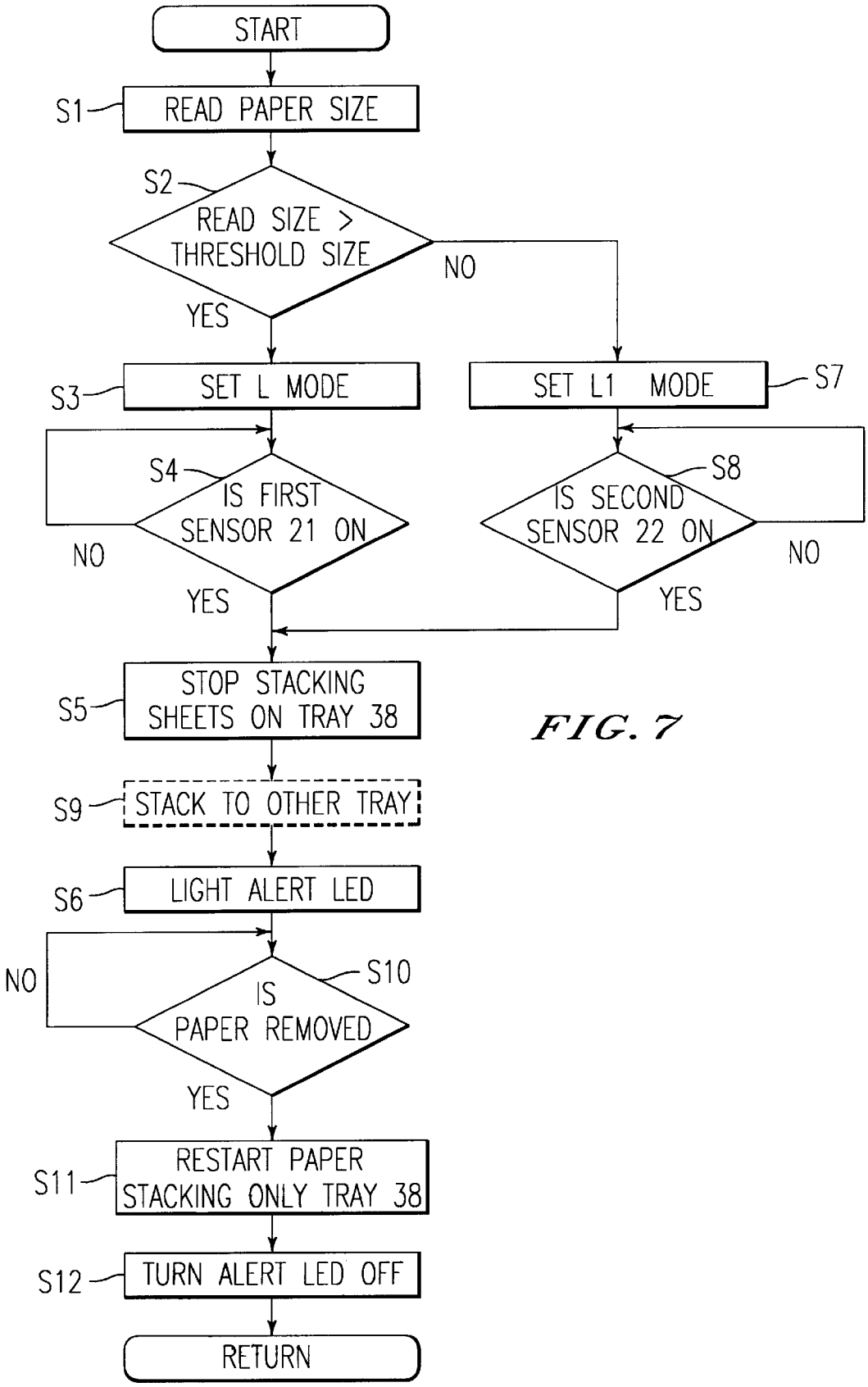
FIG. 7 shows a modification of the control operation of FIG. 5.
Figure 8:
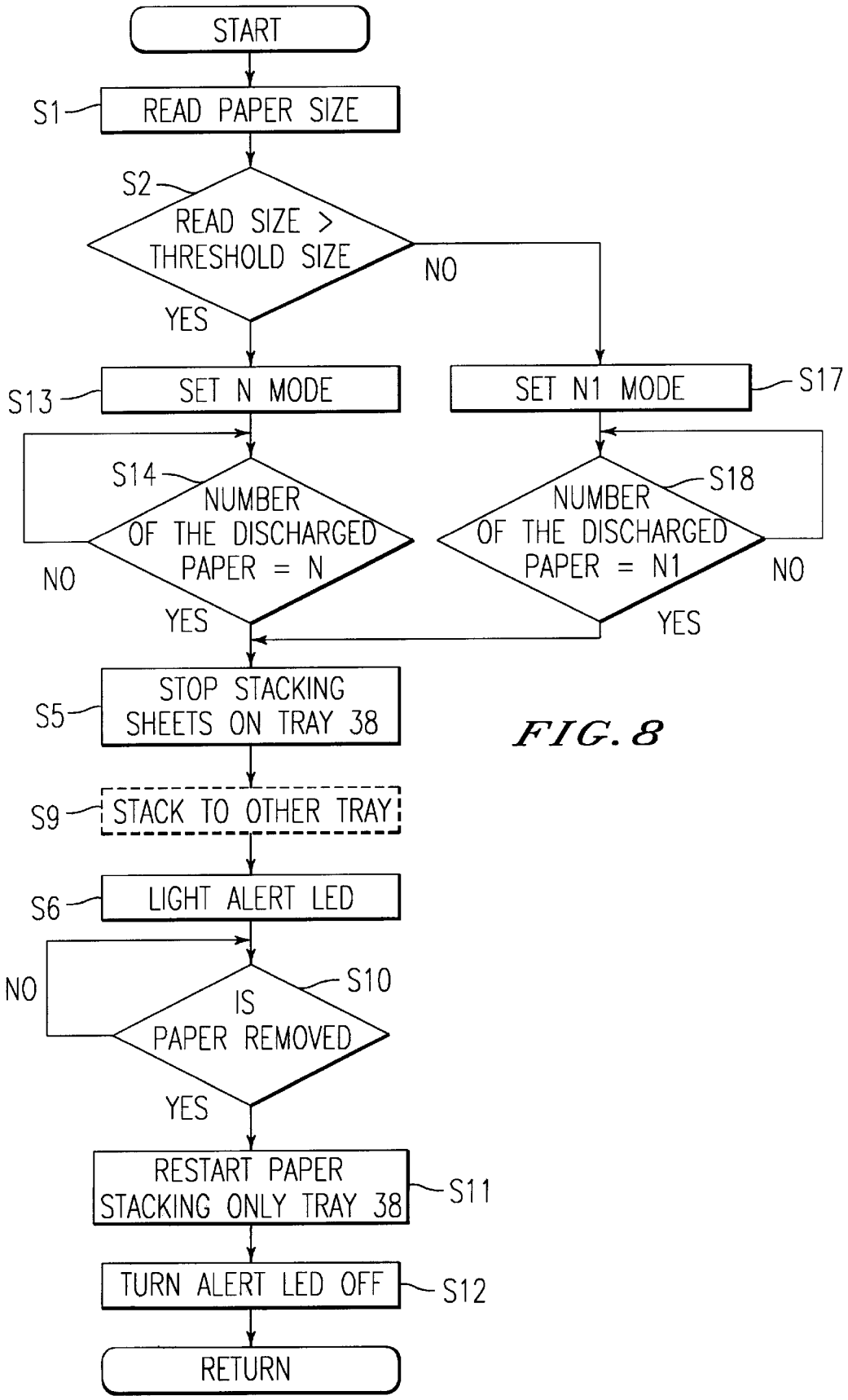
FIG. 8 shows a modification of the control operation of FIG. 6.

FIGS. 7 and 8 also disclose control operations in the present invention similar to those shown in FIGS. 5 and 6 except further including steps S10, S11 and S12 which can also be implemented. The same control steps executed in these further control operations of FIGS. 7 and 8 as executed in the control operations of FIGS. 5 and 6 are designated by the same reference numerals, and redundant explanations thereof are omitted.

More particularly, in each of these further control operations of FIGS. 7 and 8 it can be determined whether paper sheets are removed from the paper discharge tray 38 in a step S10, and if paper sheets are removed from the paper receiving tray 38, i.e., YES in step S10, stacking paper sheets onto paper receiving tray 38 is restarted in step S11, and the alert LED is then turned off in step S12. That is, if an operator removes paper sheets from the paper receiving tray 38, more paper sheets can then be stacked thereon, and thus stacking of paper sheets onto the paper receiving tray 38 can be restarted in this situation (step S11). This operation of starting to restack paper sheets onto the paper receiving tray 38 in step S11 may involve merely restarting image formation or switching to restack images onto the paper receiving tray 38 from an alternative paper receiving tray. This restarting of paper sheets is simple to implement in the embodiment shown in FIGS. 3 and 4 utilizing the float 15 as the float 15 will turn off one of the sensors 21 or 22 if paper sheets are removed from the paper receiving tray 38. To implement this operation in the control of FIG. 6 a further paper sensor can be provided to sense if paper sheets remain on the paper receiving tray 38.

Obviously, numerous additional modifications and variations of the present invention are possible in light of the above teachings. It is therefore to be understood that within the scope of the appended claims, the present invention may be practiced otherwise than as specifically described herein.

The present document is based on Japanese Priority Document 09-330102, filed in the Japanese Patent Office on Dec. 1, 1997, the entire contents of which are incorporated herein by reference.

What is claimed is:

1. An image forming apparatus, comprising:

a receiving tray configured to have a variable gap height over a sheet stacking area limited by a member formed above the sheet stacking area and to receive sheets having images formed thereon;

a controller configured to determine paper size data of the sheets having images formed thereon, and configured to control a number of the sheets having images formed thereon stacked on the sheet stacking area of the receiving tray based on the determined paper size data.

2. An image forming apparatus according to claim 1, wherein the controller determines the paper size data by comparing sheet size data of the sheets having images formed thereon with a reference sheet size data.

3. An image forming apparatus according to claim 2, wherein the controller includes a float configured to measure a height of the sheets having images formed thereon stacked on the receiving tray and first and second sensors configured to sense a position of the float.

4. An image forming apparatus according to claim 3, wherein the controller is further configured to stop stacking the sheets having images formed thereon on the receiving tray when the controller determines that the paper size data is less than the references sheet size data and the second sensor senses the float.

5. An image forming apparatus according to claim 4, wherein the controller is further configured to stop stacking the sheets having images formed thereon on the receiving tray when the controller determines that the paper size data is greater than the reference sheet size data and the first sensor senses the float.

6. An image forming apparatus according to claim 5, wherein the controller is further configured to stack the sheets having images formed thereon to an auxiliary tray when stacking the sheets having images formed thereon to the receiving tray is stopped.

7. An image forming apparatus according to claim 5, wherein the controller is further configured to restart stacking the sheets having images formed thereon to the receiving tray when at least a portion of the sheets having images formed thereon are removed from the receiving tray.

8. An image forming apparatus according to claim 5, wherein the first and second sensors are positioned to sense the float when the height of the stack of sheets having images formed thereon on the receiving tray is substantially equal to the gap height of the receiving tray at an end of the stack of sheets having images formed thereon.

9. An image forming apparatus according to claim 2, wherein the controller is configured to stop stacking the sheets having images formed thereon on the receiving tray when the controller determines that the paper size data is less than the reference paper size data and a first predetermined number of sheets are stacked on the receiving tray.

10. An image forming apparatus according to claim 9, wherein the controller is further configured to stop stacking the sheets having images formed thereon on the receiving tray when the controller determines that the paper size data is greater than the reference sheet size data and a second predetermined number of sheets are stacked on the receiving tray.

11. An image forming apparatus according to claim 10, wherein the first and second predetermined numbers are selected such that a height of stacks of the first and second predetermined number of sheets on the receiving tray is substantially equal to the gap height of the receiving tray at ends of the stacks of the first and second predetermined number of sheets.

12. An image forming apparatus according to claim 11, wherein the controller is further configured to stack the sheets having images formed thereon to an auxiliary tray when stacking the sheets having images formed thereon to the receiving tray is stopped.

13. An image forming apparatus according to claim 11, wherein the controller is further configured to restart stacking the sheets having images formed thereon to the receiving tray when at least a portion of the sheets having images formed thereon are removed from the receiving tray.

14. An image forming apparatus, comprising:

receiving means having a variable gap height over a sheet stacking area limited by a member formed above the sheet stacking area for receiving sheets having images formed thereon;

control means for determining paper size data of the sheets having images formed thereon, and for controlling a number of the sheets having images formed thereon stacked on the sheet stacking area of the receiving means based on the determined paper size data.

15. An image forming apparatus according to claim 14, wherein the control means determines the paper size data by comparing sheet size data of the sheets having images formed thereon with a reference sheet size data.

16. An image forming apparatus according to claim 15, wherein the control means includes a float means for measuring a height of the sheets having images formed thereon stacked on the receiving means and first and second sensor means for sensing a position of the float means.

17. An image forming apparatus according to claim 16, wherein the control means further stops stacking the sheets having images formed thereon on the receiving means when the control means determines that the paper size data is less than the references sheet size data and the second sensor means senses the float means.

18. An image forming apparatus according to claim 17, wherein the control means further stops stacking the sheets having images formed thereon on the receiving means when the control means determines that the paper size data is greater than the reference sheet size data and the first sensor means senses the float means.

19. An image forming apparatus according to claim 18, wherein the control means further restarts stacking the sheets having images formed thereon to the receiving means when at least a portion of the sheets having images formed thereon are removed from the receiving means.

20. An image forming apparatus according to claim 18, wherein the first and second sensor means are positioned to sense the float means when the height of the stack of sheets having images formed thereon on the receiving means is substantially equal to the gap height of the receiving means at an end of the stack of sheets having images formed thereon.

21. An image forming apparatus according to claim 18, wherein the control means further stacks the sheets having images formed thereon to an auxiliary receiving means when stacking the sheets having images formed thereon to the receiving means is stopped.

22. An image forming apparatus according to claim 19, wherein the control means stops stacking the sheets having images formed thereon on the receiving means when the control means determines that the paper size data is less than the reference paper size data and a first predetermined number of sheets are stacked on the receiving means.

23. An image forming apparatus according to claim 22, wherein the control means further stops stacking the sheets having images formed thereon on the receiving means when the control means determines that the paper size data is greater than the reference sheet size data and a second predetermined number of sheets are stacked on the receiving means.

24. An image forming apparatus according to claim 23, wherein the first and second predetermined numbers are selected such that a height of stacks of the first and second predetermined number of sheets on the receiving means is substantially equal to the gap height of the receiving means at ends of the stacks of the first and second predetermined number of sheets.

25. An image forming apparatus according to claim 24, wherein the control means further stacks the sheets having images formed thereon to an auxiliary receiving means when stacking the sheets having images formed thereon to the receiving means is stopped.

26. An image forming apparatus according to claim 24, wherein the control means further restarts stacking the sheets having images formed thereon to the receiving means when at least a portion of the sheets having images formed thereon are removed from the receiving means.

27. A control operation for an image forming apparatus including a receiving tray configured to have a variable gap height over a sheet stacking area limited by a member formed above the sheet stacking area and to receive sheets having images formed thereon, comprising steps of:

determining paper size data of the sheets having images formed thereon, and controlling a number of the sheets having images formed thereon stacked on the sheet stacking area of the receiving tray based on the determined paper size data.

28. A control operation according to claim 27, wherein the controlling step determines the paper size data by comparing sheet size data of the sheets having images formed thereon with a reference sheet size data.

29. A control operation according to claim 28, wherein the controlling step measures a height of the sheets having images formed thereon stacked on the receiving tray with a float and senses a position of the float with first and second sensors.

30. A control operation according to claim 29, wherein the controlling step stops stacking the sheets having images formed thereon on the receiving tray when the controlling step determines that the paper size data is less than the references sheet size data and the second sensor senses the float.

31. A control operation according to claim 30, wherein the controlling step further stops stacking the sheets having images formed thereon on the receiving tray when the controlling step determines that the paper size data is greater than the reference sheet size data and the first sensor senses the float.

32. A control operation according to claim 31, wherein the controlling step further stacks the sheets having images formed thereon to an auxiliary tray when stacking the sheets having images formed thereon to the receiving tray is stopped.

33. An image forming apparatus according to claim 31, wherein the controlling step further restarts stacking the sheets having images formed thereon to the receiving tray when at least a portion of the sheets having images formed thereon are removed from the receiving tray.

34. An image forming apparatus according to claim 31, wherein the first and second sensors are positioned to sense the float when the height of the stack of sheets having images formed thereon on the receiving tray is substantially equal to the gap height of the receiving tray at an end of the stack of sheets having images formed thereon.

35. An image forming apparatus according to claim 28, wherein the controlling step stops stacking the sheets having images formed thereon on the receiving tray when the controlling step determines that the paper size data is less than the reference paper size data and a first predetermined number of sheets are stacked on the receiving tray.

36. An image forming apparatus according to claim 35, wherein the controlling step further stops stacking the sheets having images formed thereon on the receiving tray when the controlling step determines that the paper size data is greater than the reference sheet size data and a second predetermined number of sheets are stacked on the receiving tray.

37. An image forming apparatus according to claim 36, wherein the first and second predetermined numbers are selected such that a height of stacks of the first and second predetermined number of sheets on the receiving tray is substantially equal to the gap height of the receiving tray at ends of the stacks of the first and second predetermined number of sheets.

38. An image forming apparatus according to claim 37, wherein the controlling step further stacks the sheets having images formed thereon to an auxiliary tray when stacking the sheets having images formed thereon to the receiving tray is stopped.

39. An image forming apparatus according to claim 37, wherein the controlling step further restarts stacking the sheets having images formed thereon to the receiving tray when at least a portion of the sheets having images formed thereon are removed from the receiving tray.

* * * * *